US011101612B2

(12) United States Patent
Zhu et al.

(10) Patent No.: US 11,101,612 B2
(45) Date of Patent: Aug. 24, 2021

(54) METHOD OF MANUFACTURING ELECTRICAL CONNECTOR

(71) Applicant: CHENG UEI PRECISION INDUSTRY CO., LTD., New Taipei (TW)

(72) Inventors: Feng Zhu, Dong-Guan (CN); Zhi-Bin Dong, Dong-Guan (CN); Jun Chen, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 202 days.

(21) Appl. No.: 16/387,529

(22) Filed: Apr. 17, 2019

(65) Prior Publication Data

US 2019/0372292 A1 Dec. 5, 2019

(30) Foreign Application Priority Data

Jun. 4, 2018 (CN) ..... 201810562541.1

(51) Int. Cl.
*H01R 43/24* (2006.01)
*H01R 4/48* (2006.01)

(52) U.S. Cl.
CPC ..... *H01R 43/24* (2013.01); *H01R 4/48* (2013.01)

(58) Field of Classification Search
CPC ..... H01R 4/48; H01R 43/24
See application file for complete search history.

(56) References Cited

FOREIGN PATENT DOCUMENTS

| | | | |
|---|---|---|---|
| CN | 2531914 Y | * | 1/2003 |
| CN | 201191668 Y | * | 2/2009 |
| CN | 201194308 Y | * | 2/2009 |
| CN | 107591664 A | * | 1/2018 |

* cited by examiner

*Primary Examiner* — Carl J Arbes
(74) *Attorney, Agent, or Firm* — Cheng-Ju Chiang

(57) ABSTRACT

A method of manufacturing an electrical connector includes specific steps described hereinafter. Stamp a plurality of terminals together with a plurality of clamping portions and a clamping element having a material belt. Insert and fix the plurality of the terminals together with the plurality of the clamping portions to a material carrier, and place the material belt above the material carrier. Electroplate the plurality of the terminals and the clamping element. Mold an insulating housing to the plurality of the terminals and the clamping element. Separate the material carrier, the plurality of the clamping portions and the material belt from the plurality of the terminals and the clamping element respectively, thereby completing manufacturing the electrical connector which has the insulating housing, the plurality of the terminals and the clamping element.

16 Claims, 14 Drawing Sheets

METHOD OF MANUFACTURING ELECTRICAL CONNECTOR

CROSS-REFERENCE TO RELATED APPLICATION

The present application is based on, and claims priority form, China Patent Application No. 201810562541.1, filed Jun. 4, 2018, the disclosure of which is hereby incorporated by reference herein in its entirety.

BACKGROUND OF THE INVENTION

1. Field of the Invention

The present invention generally relates to a method of manufacturing an electrical connector, and more particularly to a method of manufacturing an electrical connector which is capable of accelerating a production process of the electrical connector by virtue of an automatic process.

2. The Related Art

With reference to FIG. 10 to FIG. 14, a conventional method of manufacturing an electrical connector 200' in prior art is generally applied. The conventional method of manufacturing the electrical connector 200' is implemented according to the following steps. Step one: stamp a plurality of terminals 50' and a clamping element 60', respectively. Step two: electroplate the plurality of the terminals 50' and the clamping element 60', respectively. Step three: the plurality of the terminals 50' are mounted on a fixing fixture 30', respectively. Step four: the fixing fixture 30' is assembled on a material carrier 10'. Step five: a material belt 20' is assembled to the fixing fixture 30', at the same time, the clamping element 60' is placed above the plurality of the terminals 50'. Step six: an insulating housing 40' is molded to the plurality of the terminals 50' and the clamping element 60'. Step seven: separate a plurality of clamping portions 70' connected with tail ends of the plurality of the terminals 50' and the material belt 20' from the plurality of the terminals 50' and the clamping element 60', respectively, thereby completing manufacturing the electrical connector 200' which includes the insulating housing 40', the plurality of the terminals 50' and the clamping element 60'.

When performing the step one, the plurality of the clamping portions 70' are punched at rear ends of the plurality of the terminals 50' in advance, and at the same time, the material belt 20' is punched. The material belt 20' has a base portion 23', an extending portion 21' extended frontward and bent downward from a middle of a front of the base portion 23', and a fixing portion 22' extended outward from two sides of the extending portion 21'. A front end of the extending portion 21' is connected with a substantially U-shaped clamping element 60'. A mouth of the clamping element 60' faces frontward.

When performing the step two, the plurality of the clamping portions 70' of the plurality of the terminals 50' are mounted in a plurality of fastening slots 32' formed at a bottom of the fixing fixture 30', respectively.

When performing the step four, two sides of a rear of the material carrier 10' are bent upward to form two fixing slices 11' assembled in two fixing grooves 31' opened in the bottom of the fixing fixture 30', and two sides of a top of the fixing fixture 30' are recessed downward to form two fastening grooves 331', two sides of the fixing portion 22' are assembled in the two fastening grooves 331'.

When performing the step six, the plurality of the terminals 50' and the clamping element 60' are placed in a mold for molding the insulating housing 40', and the insulating housing 40' is molded to the plurality of the terminals 50' and the clamping element 60' by an injection molding technology.

However, an additional fixing fixture 30' is required to complete manufacturing the electrical connector 200'. In addition, the fixing fixture 30' is a plastic product, so the plurality of the terminals 50' and the clamping element 60' has no way of being directly electroplated after the insulating housing 40' is molded to the plurality of the terminals 50' and the clamping element 60', so it is too tedious in a process of manufacturing the electrical connector 200' that increases manufacturing time, manufacturing procedures and cost expenditures of the electrical connector 200'.

Therefore, it is necessary to provide an innovative method of manufacturing an electrical connector for decreasing redundant manufacturing time and cost expenditures of the electrical connector, and accelerating a production process of the electrical connector by virtue of an automatic process.

SUMMARY OF THE INVENTION

An object of the present invention is to provide a method of manufacturing an electrical connector. Specific steps of the method of manufacturing the electrical connector are described hereinafter. Stamp a plurality of terminals together with a plurality of clamping portions and a clamping element having a material belt, respectively. Insert and fix the plurality of the terminals together with the plurality of the clamping portions to a material carrier, and place the material belt above the material carrier, at the moment, the clamping element is located above the plurality of the terminals. Electroplate the plurality of the terminals and the clamping element. Mold an insulating housing to the plurality of the terminals and the clamping element. Separate the material carrier, the plurality of the clamping portions and the material belt from the plurality of the terminals and the clamping element respectively, thereby completing manufacturing the electrical connector which has the insulating housing, the plurality of the terminals and the clamping element.

Another object of the present invention is to provide a method of manufacturing an electrical connector. Specific steps of the method of manufacturing the electrical connector are described hereinafter. Stamp a plurality of terminals together with a plurality of clamping portions and a clamping element having a material belt. Insert and fix the plurality of the terminals together with the plurality of the clamping portions to a material carrier, and place the material belt above the material carrier. Electroplate the plurality of the terminals and the clamping element. Mold an insulating housing to the plurality of the terminals and the clamping element. Separate the material carrier, the plurality of the clamping portions and the material belt from the plurality of the terminals and the clamping element respectively, thereby completing manufacturing the electrical connector which has the insulating housing, the plurality of the terminals and the clamping element.

Another object of the present invention is to provide a method of manufacturing an electrical connector. Specific steps of the method of manufacturing the electrical connector are described hereinafter. Stamp a plurality of terminals together with a plurality of clamping portions and a clamping element having a material belt, respectively. Insert and fix the plurality of the terminals together with the plurality of the clamping portions to a material carrier, and place the material belt above the material carrier, the material carrier opens a plurality of limiting slots, the plurality of the clamping portions are limited in the plurality of the limiting slots. Electroplate the plurality of the terminals and the clamping element. Mold an insulating housing to the plurality of the terminals and the clamping element. Separate the material carrier, the plurality of the clamping portions and the material belt from the plurality of the terminals and the clamping element respectively, thereby completing manufacturing the electrical connector which has the insulating housing, the plurality of the terminals and the clamping element.

As described above, the method of manufacturing the electrical connector in according with the present invention is performed by adding the plurality of the limiting slots to the material carrier, compare the method of manufacturing the electrical connector in accordance with the present invention with a method of manufacturing an electrical connector in prior art, the electrical connector may be manufactured without need of the fixing fixture, thereby decreasing manufacturing time of the electrical connector, removing a cost burden of the fixing fixture and accelerating a production process of the electrical connector by virtue of an automatic process.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
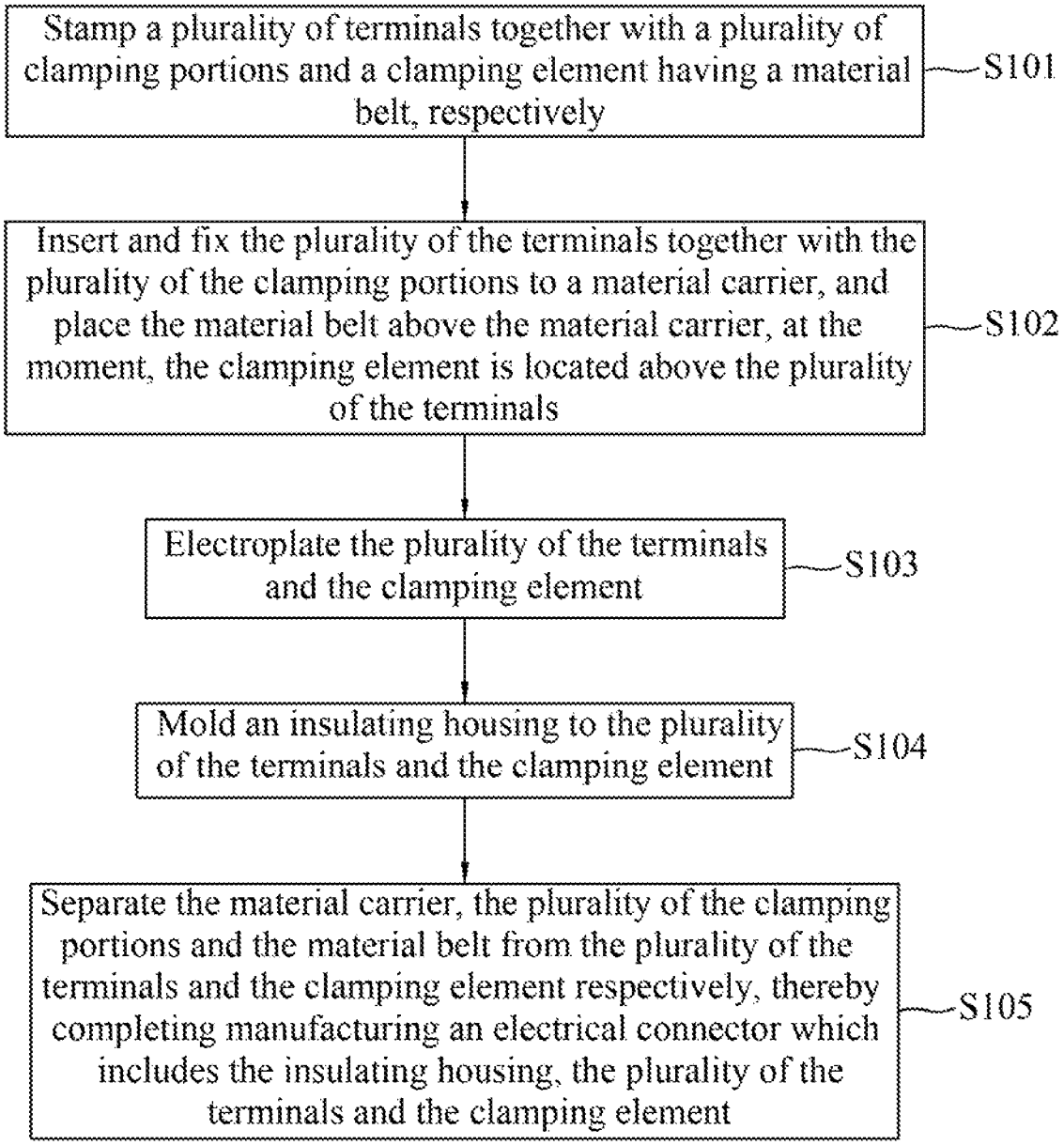
FIG. 1 is a process flow chart of a method of manufacturing an electrical connector in accordance with the present invention.

With reference to FIG. 1 to FIG. 8, a method of manufacturing an electrical connector 200 in accordance with the present invention is shown. When the method of manufacturing the electrical connector 200 is utilized, a material carrier 10 and a material belt 20 are applied in manufacturing the electrical connector 200. The electrical connector 200 includes an insulating housing 40, a plurality of terminals 50 and a clamping element 60. Specific steps of the method of manufacturing the electrical connector 200 are described as follows. Step S101: stamp the plurality of the terminals 50 together with a plurality of clamping portions 70 and the clamping element 60 having the material belt 20, respectively. Step S102: insert and fix the plurality of the terminals 50 together with the plurality of the clamping portions 70 to the material carrier 10 by use of a pin machine, and place the material belt 20 above the material carrier 10, at the moment, the clamping element 60 is located above the plurality of the terminals 50. Step S103: electroplate the plurality of the terminals 50 and the clamping element 60. Step S104: mold the insulating housing 40 to the plurality of the terminals 50 and the clamping element 60. Step S105: separate the material carrier 10, the plurality of the clamping portions 70 and the material belt 20 from the plurality of the terminals 50 and the clamping element 60 respectively, thereby completing manufacturing the electrical connector 200 which includes the insulating housing 40, the plurality of the terminals 50 and the clamping element 60.

Figure 8:
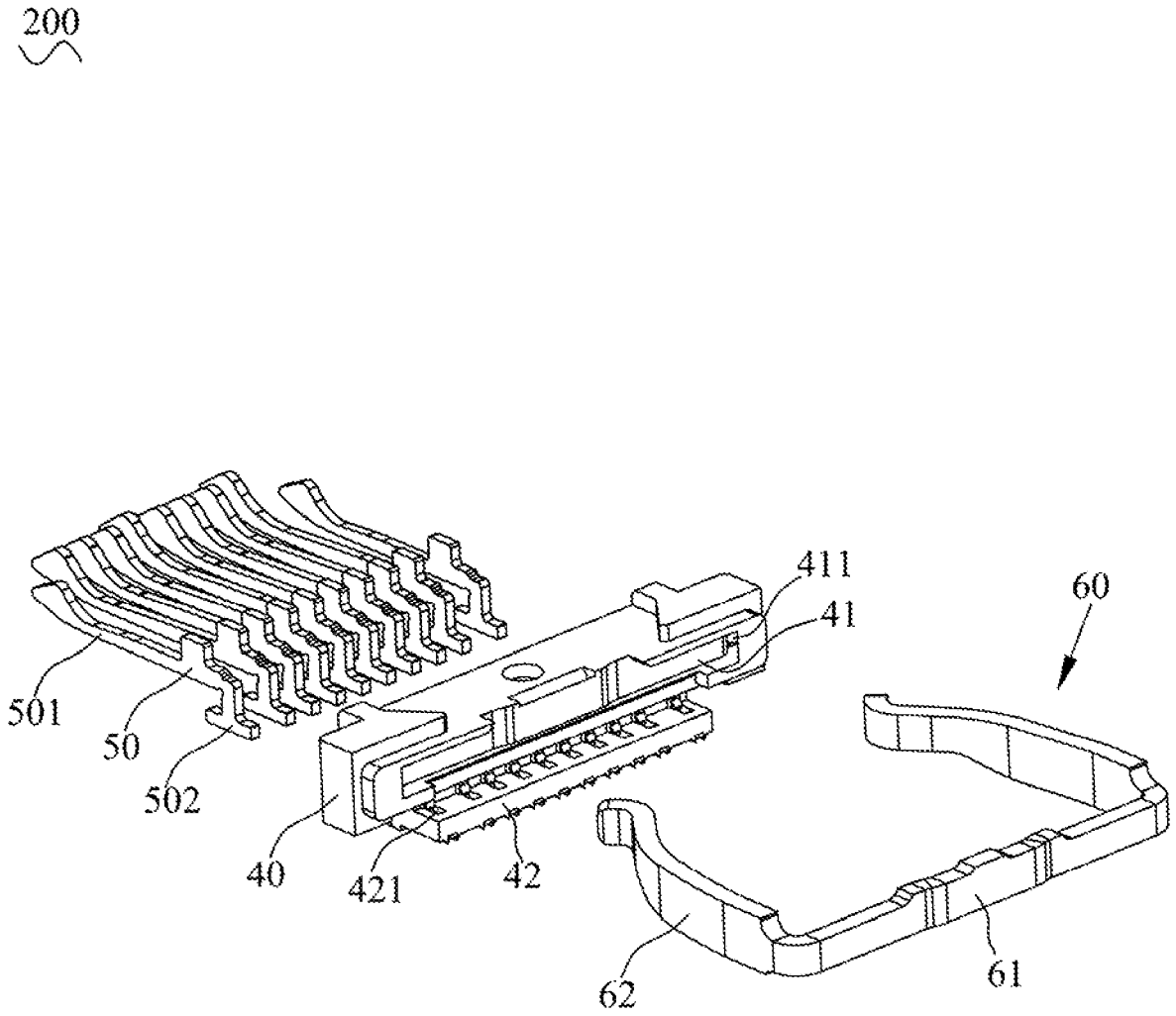
FIG. 8 is an exploded perspective view of the electrical connector manufactured by the method in accordance with the present invention.
Figure 9:
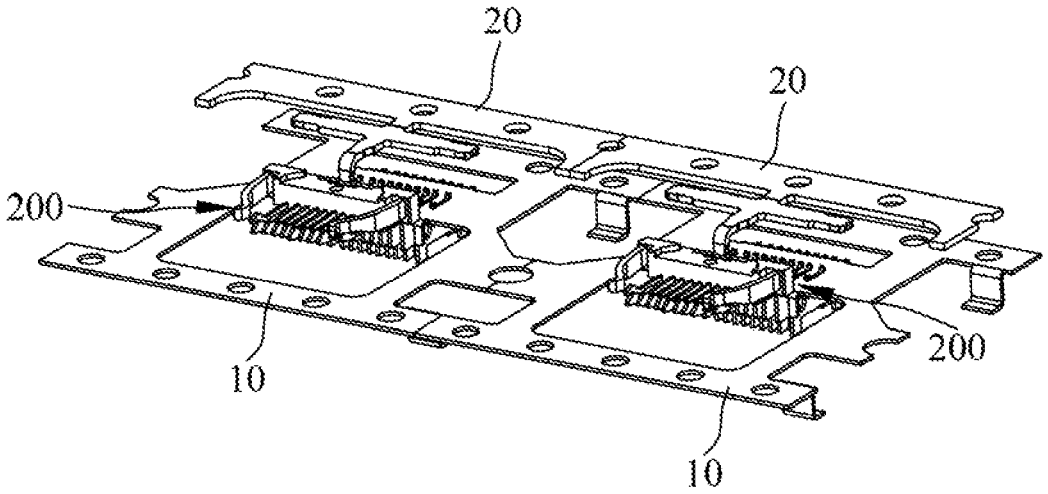
FIG. 9 is a perspective view showing that two connected material carriers, two connected material belts and two electrical connectors of FIG. 8.
Figure 10:
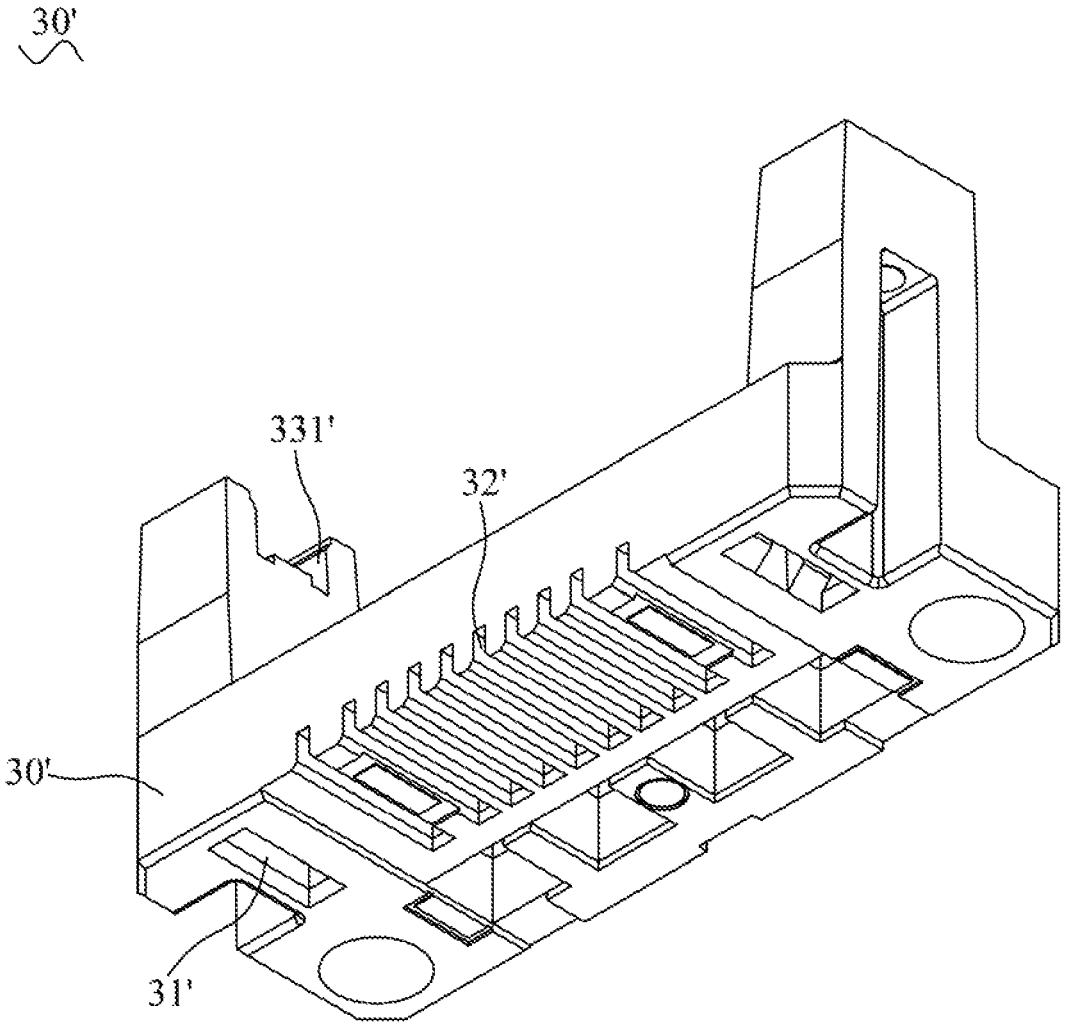
FIG. 10 (Prior Art)
FIG. 10 is a perspective view of a fixing fixture in prior art.
Figure 11:
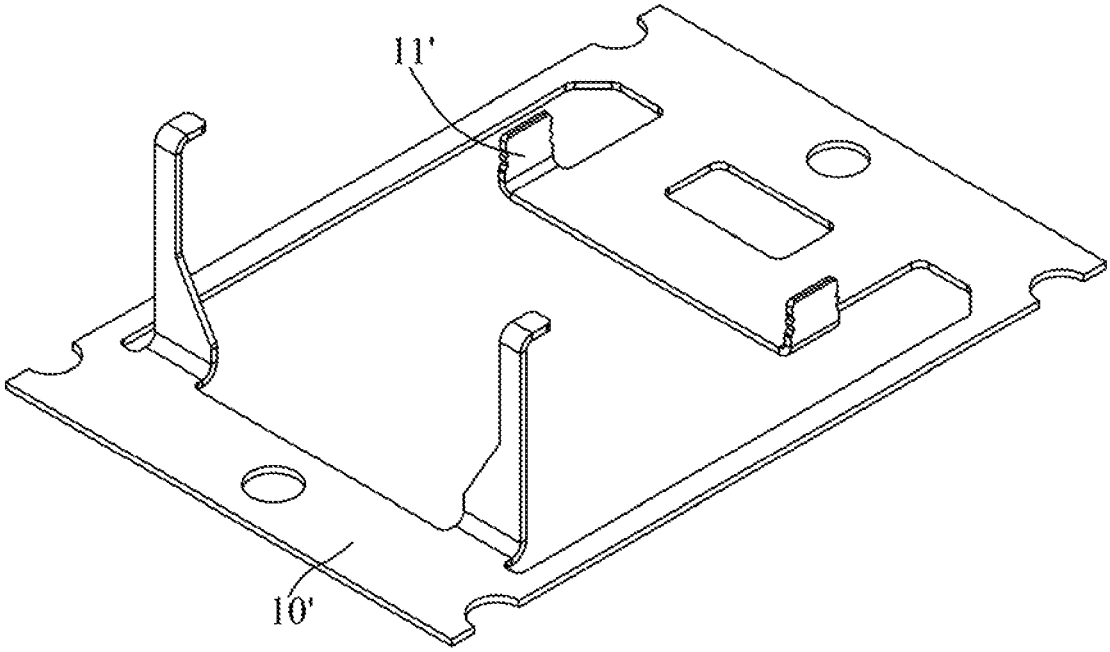
FIG. 11 (Prior Art)
FIG. 11 is a perspective view of a material carrier in the prior art.
Figure 12:
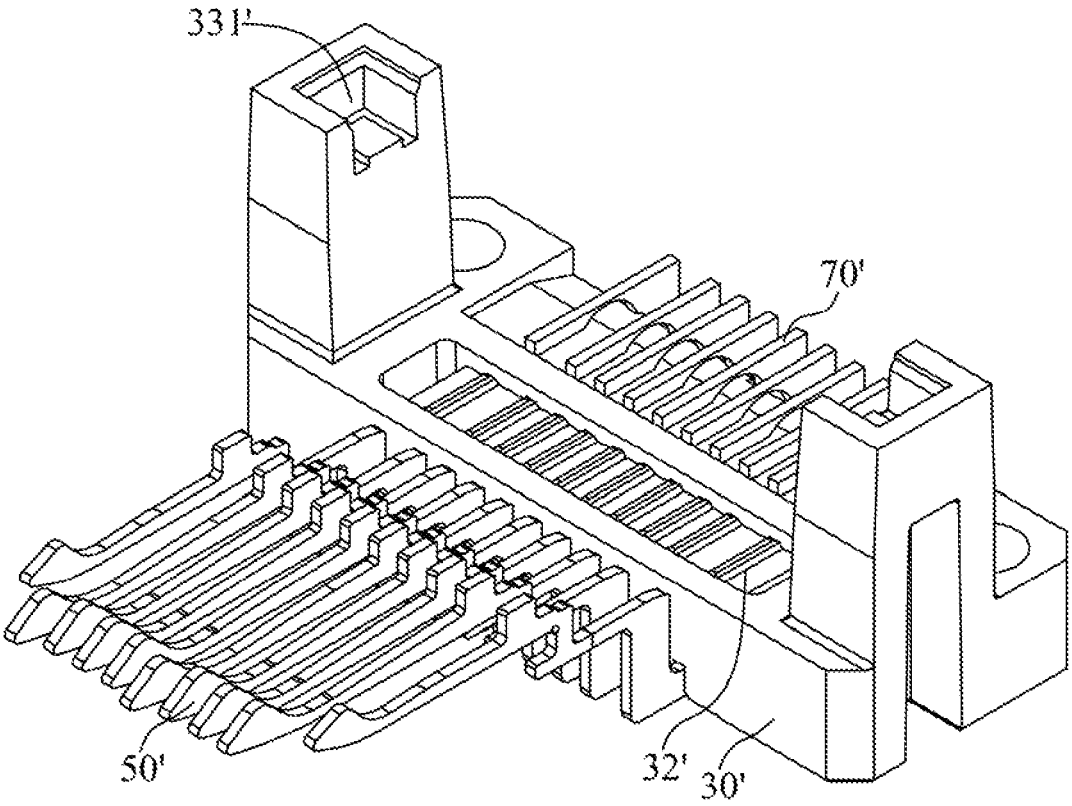
FIG. 12 (Prior Art)
FIG. 12 is a perspective view showing that a plurality of terminals and a plurality of clamping portions are fixed in the fixing fixture in the prior art.
Figure 13:
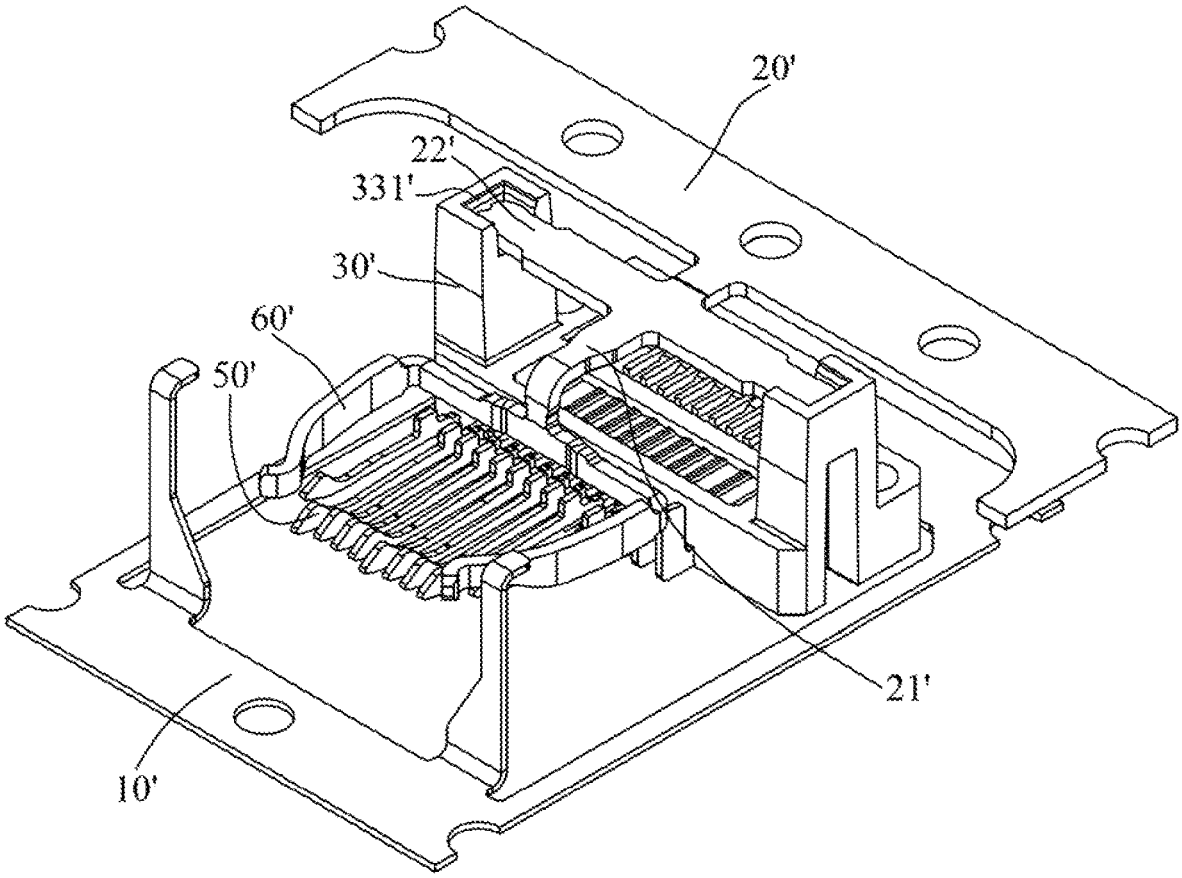
FIG. 13 (Prior Art)
FIG. 13 is a perspective view showing that the plurality of the terminals, the clamping element, the fixing fixture, the material carrier and the material belt in the prior art.
Figure 14:
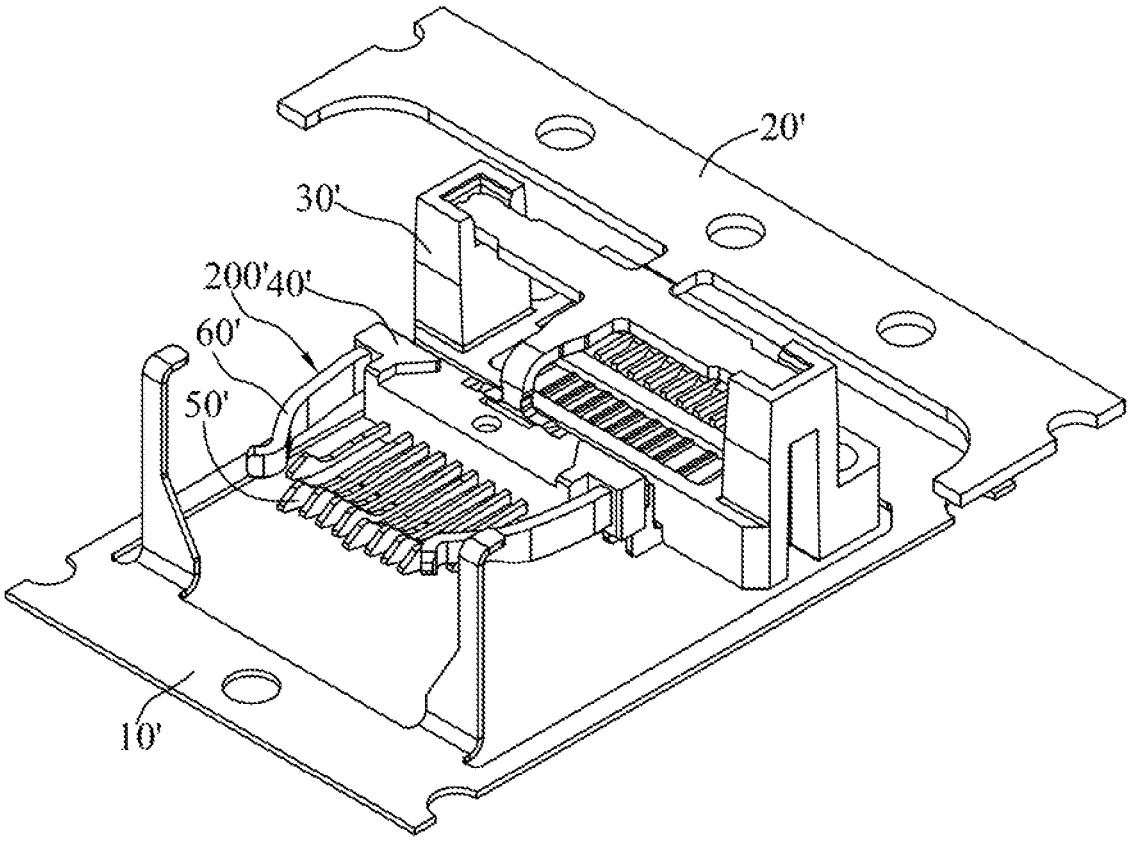
FIG. 14 (Prior Art)
FIG. 14 is a perspective view showing that an electrical connector, the fixing fixture, the material carrier and the material belt in the prior art.

With reference to FIG. 8, The insulating housing 40 has a first surface 401 and a second surface 402 in respect with the first surface 401, and the second surface 402 is protruded to form a locating groove 41. Two ends of the locating groove 41 extend frontward and longitudinally penetrating through the first surface 401 and the second surface 402 of the insulating housing 40 to form two clamping slots 411. A Terminal base 42 is formed in bottom of the locating groove 41 which has a plurality of terminal slots 421 penetrating through the first surface 401 and the second surface 402 of the insulating housing 40 for accommodating the plurality of the terminals 50. Each of the terminals 50 has a contacting end 501 and an assembling end 502, the contacting end 501 is assembled beyond the first surface 401 of the insulating housing 40 after assembled. The clamping element 60 is of a substantially U shape which has a mouth facing the second surface 402 of the insulating housing 40 and disposed in the locating groove 41 and the two clamping slots 411. The clamping element 60 has a locating portion 61 extending transversely. Two ends of the locating portion 61 are bent frontward and then arched inward to form a pair of clamping arms 62. The locating portion 61 is located in the locating groove 41. The pair of the clamping arms 62 are clamped in the two clamping slots 411.

Figure 3:
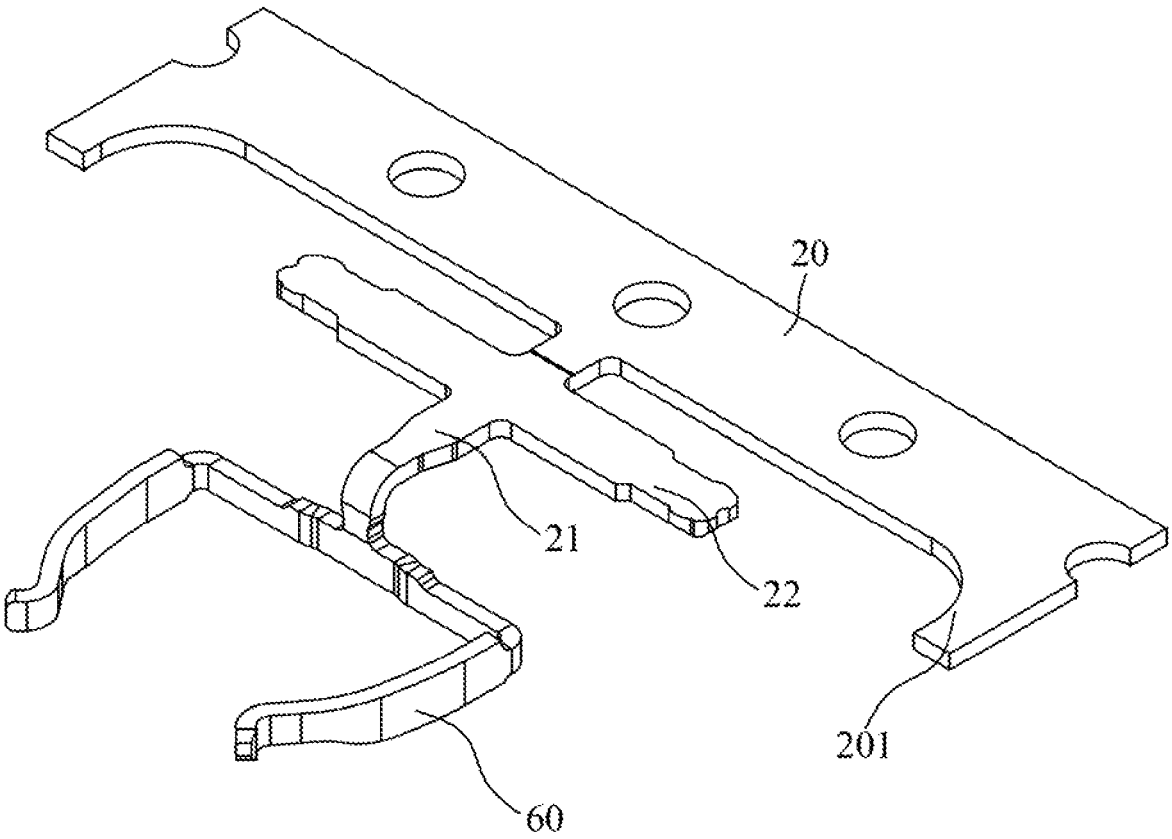
FIG. 3 is a perspective view of a material belt and a stamped clamping element in accordance with the present invention.
Figure 4:
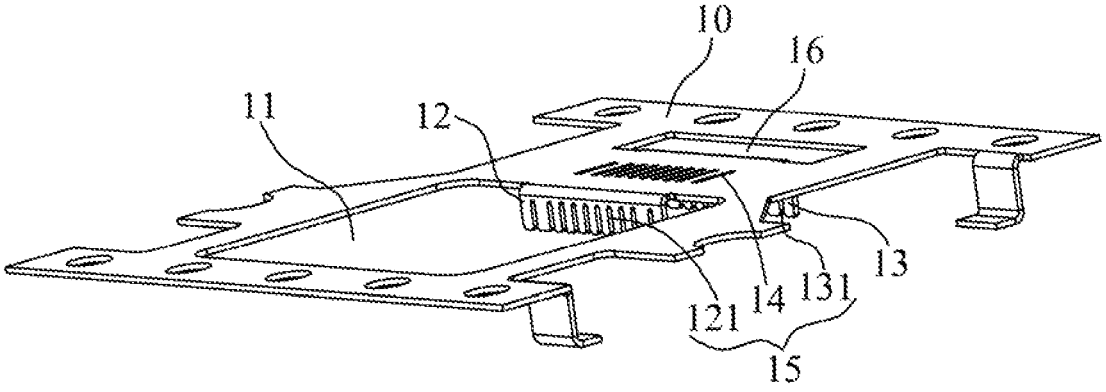
FIG. 4 is a perspective view of a material carrier in accordance with the present invention.
Figure 5:
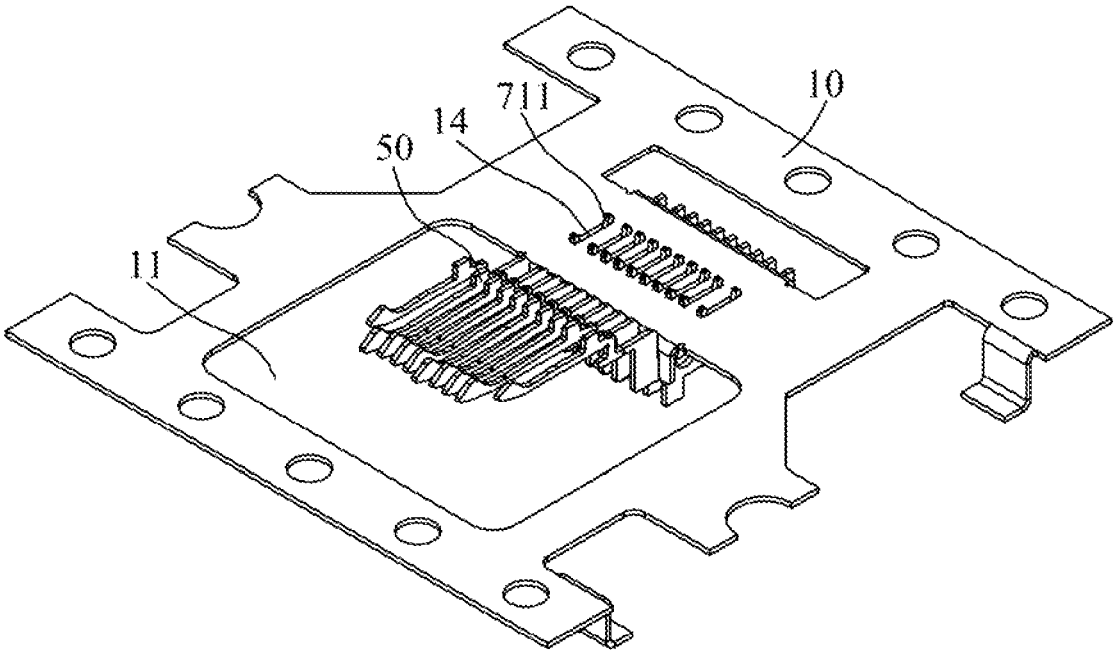
FIG. 5 is a perspective view showing that the plurality of the terminals are fastened to the material carrier in accordance with the present invention.
Figure 6:
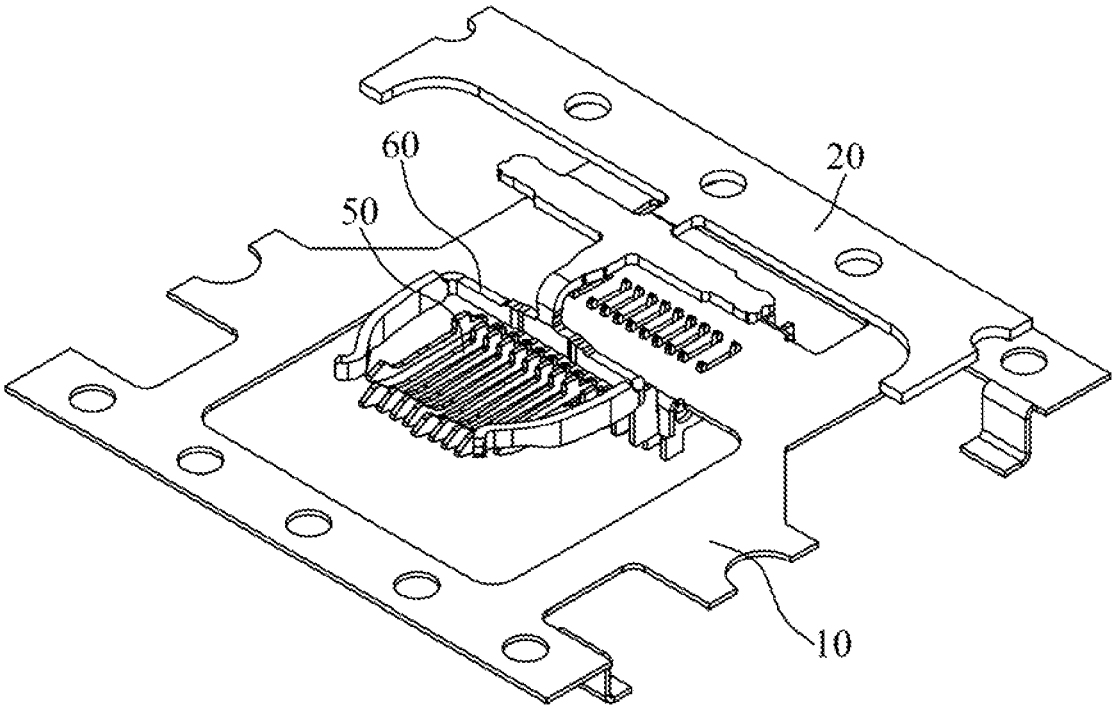
FIG. 6 is a perspective view showing that the material carrier, the material belt, the plurality of the terminals and the clamping element in accordance with the present invention.

With reference to FIG. 3 and FIG. 4, the material carrier 10 and the material belt 20 are made of metal materials. The material carrier 10 has a first opening 11 penetrating through one end of the material carrier 10, and a second opening 16 penetrating through another end of the material carrier 10 in opposite to the first opening 11. The first opening 11 and the second opening 16 are respectively punched downward to form a first extension portion 12 and a second extension portion 13. The second extension portion 13 is disposed parallel with the first extension portion 12. The first extension portion 12 is protruded downward from a side wall of the first opening 11 adjacent to the second opening 16. The second extension portion 13 is also protruded downward from a side wall of the second opening 16 in opposite to the first extension portion 12.

A surface of the first extension portion 12 is recessed to form a plurality of first slots 121 arranged transversely. A surface of the second extension portion 13 is also recessed to form a plurality of second slots 131. A plurality of insertion slots 14 is located between the first extension portion 12 and the second extension portion 13, and vertically penetrated through the material carrier 10.

Figure 2:
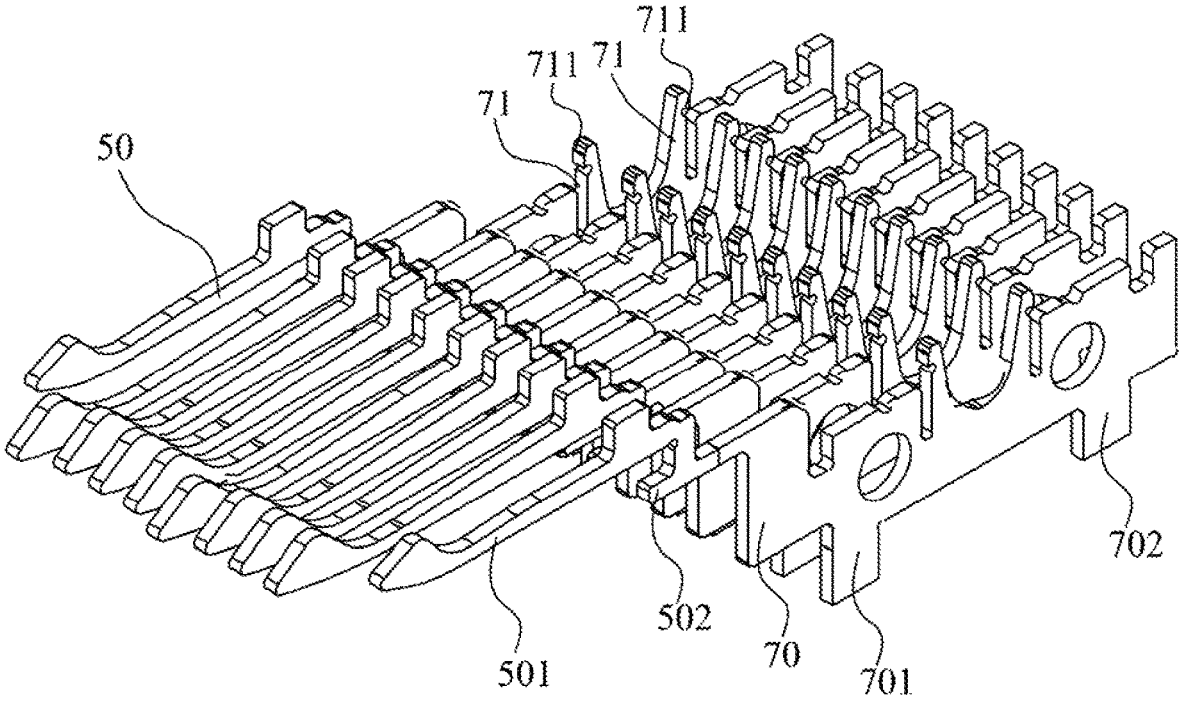
FIG. 2 is a perspective view of a plurality of stamped terminals in accordance with the present invention.

With reference to FIG. 1 to FIG. 3, when performing the step S101, the plurality of the clamping portions 70 are punched at the assembling end 502 of the plurality of the terminals 50, respectively. A middle of each of the clamping portions 70 protrude upward to form two pillars 71 with opposite each other. Top ends of the two pillars 71 protrude outward to form two barbs 711. A first pin 701 and a second pin 702 are respectively extending from each of the clamping portions 70 in opposite with the barbs 711, the barbs 711 is remaining a distance from each other. After the material belt 20 is punched, the material belt 20 has a base portion 201, an extending portion 21 extended frontward and bent downward from a middle of a front of the base portion 201, and a fixing portion 22 extended outward from two sides of the extending portion 21. A free end of the extending portion 21 is connected with the clamping element 60.

With reference to FIG. 1 to FIG. 6, when performing the step S102, the plurality of the terminals 50 are fixed to the material carrier 10 via the pin inserting machine. The plurality of the clamping portions 70 are limited in the plurality of the limiting slots 15.

Specifically, the first pin 701 and the second pin 702 of the clamping portions 70 are mounted in the first slots 121 and the second slots 131 of the material carrier 10, respectively. After assembled, the plurality of the terminals 50 and the first pin 701 of each of the clamping portions 70 located within the first opening 11. The second pin 702 of each of the clamping portions 70 located within the second opening 16. The pillars 71 of each of the clamping portions 70 are inserted into each of the insertion slots 14 of the material carrier 10, respectively. The pillars 71 of each of the clamping portions 70 project beyond and hook the surface of the material carrier 10, and the material belt 20 is placed above the material carrier 10, at the same time, the clamping element 60 is located above the plurality of the terminals 50. So when performing the step S103, the plurality of the terminals 50 and the clamping element 60 are electroplated directly.

Figure 7:
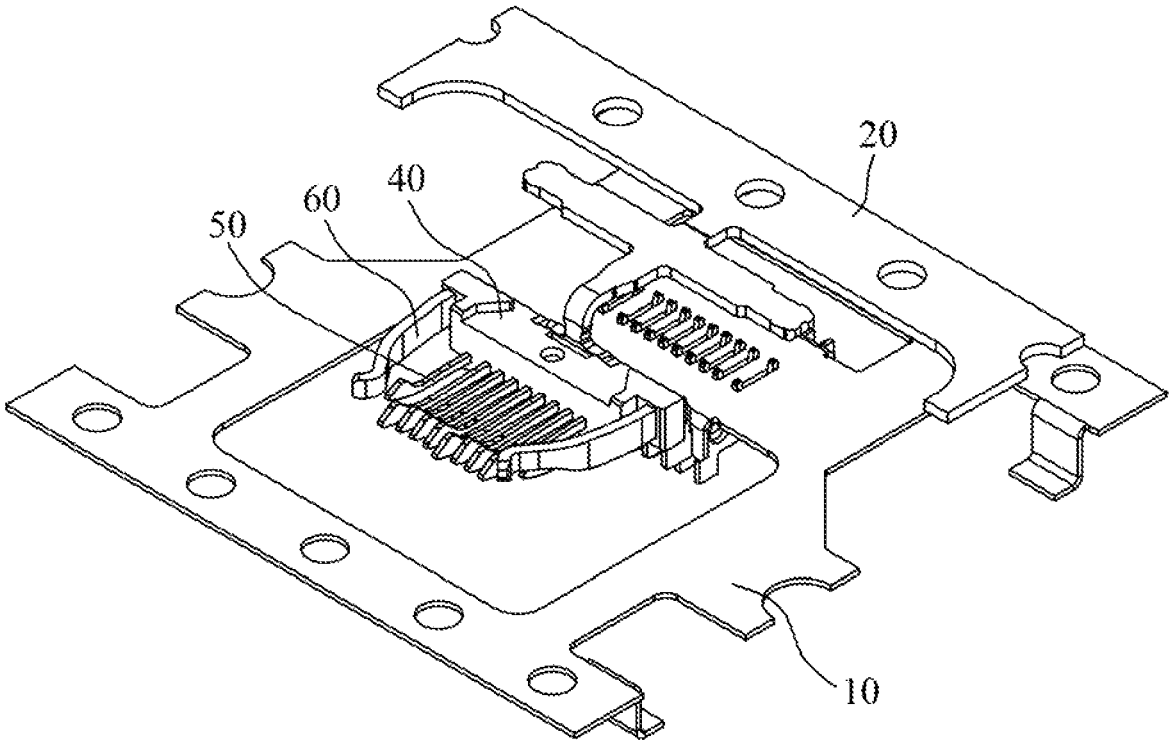
FIG. 7 is a perspective view showing an insulating housing, the material carrier, the material belt, the plurality of the terminals and the clamping element in accordance with the present invention.

With reference to FIG. 1 and FIG. 7, when performing the step S104, the plurality of the terminals 50 and the clamping element 60 are placed in a mold for molding the insulating housing 40, and the insulating housing 40 is molded to the plurality of the terminals 50 and the clamping element 60 by an injection molding technology.

With reference to FIG. 1 to FIG. 14, the method of manufacturing the electrical connector 200 is performed by adding the plurality of the limiting slots 15 to the material carrier 10, compare the method of manufacturing the electrical connector 200 in accordance with the present invention with a method of manufacturing an electrical connector 200' in prior art, when the plurality of the terminals 50 and the clamping element 60 of the electrical connector 200 are electroplated, a process of molding the insulating housing 40 by the injection molding technology may be performed directly after electroplating the plurality of the terminals 50 and the clamping element 60. Whereas the plurality of the terminals 50' and the clamping element 60' in the prior art are requested to be separately electroplated and then the plurality of the terminals 50' are mounted in the plurality of the fastening slots 32' of the fixing fixture 30' to proceed an injection molding process of the insulating housing 40'. In addition, in the process of manufacturing the electrical connector 200' in the prior art, the method of manufacturing the electrical connector 200' in the prior art needs the fixing fixture 30' to proceed an injection molding process of the insulating housing 40', compare the method of manufacturing the electrical connector 200 in accordance with the present invention with the method of manufacturing the electrical connector 200' in the prior art, manufacturing time, manufacturing procedures and cost expenditures of the electrical connector 200 are decreased, and simultaneously, a dimensional stability of the plurality of the limiting slots 15 of the material carrier 10 is better than a dimensional stability of the plurality of the fastening slots 32' of the fixing fixture 30'.

The material carrier 10 and the material belt 20 are automatically provided for manufacturing the electrical connector 200 by way of reels, so the plurality of the terminals 50 and the clamping element 60 of the electrical connector 200 are automatically electroplated. The insulating housing 40 is automatically molded to the plurality of the terminals 50 and the clamping element 60.

As described above, the method of manufacturing the electrical connector 200 in according with the present invention is performed by adding the plurality of the limiting slots 15 to the material carrier 10, compare the method of manufacturing the electrical connector 200 in accordance with the present invention with the method of manufacturing the electrical connector 200' in the prior art, the electrical connector 200 may be manufactured without need of the fixing fixture 30', thereby decreasing the manufacturing time of the electrical connector 200, removing a cost burden of the fixing fixture 30', and accelerating a production process of the electrical connector 200 by virtue of an automatic process.

What is claimed is:

1. A method of manufacturing an electrical connector having an insulating housing, comprising steps of:

stamping a plurality of terminals together with a plurality of clamping portions and a clamping element having a material belt, respectively, wherein the clamping element is of a substantially U shape which has a mouth facing the insulating housing, the clamping element has a locating portion extending transversely, two ends of the locating portion are bent frontward and then arched inward to form a pair of clamping arms, a middle of a rear surface of the insulating housing is recessed frontward to form a locating groove, two ends of the locating groove extend frontward and longitudinally penetrating through a first surface and a second surface of the insulating housing to form two clamping slots, the locating portion is located in the locating groove, the pair of the clamping arms are clamped in the two clamping slots;

inserting and fixing the plurality of the terminals together with the plurality of the clamping portions to a material carrier, and placing the material belt above the material carrier, at the moment, the clamping element being located above the plurality of the terminals;

electroplating the plurality of the terminals and the clamping element;

molding an insulating housing to the plurality of the terminals and the clamping element; and separating the material carrier, the plurality of the clamping portions and the material belt from the plurality of the terminals and the clamping element respectively, thereby completing manufacturing the electrical connector which has the insulating housing, the plurality of the terminals and the clamping element.

2. The method of manufacturing the electrical connector as claimed in claim 1, wherein the plurality of the terminals and the clamping element are placed in a mold for molding the insulating housing, and the insulating housing is molded to the plurality of the terminals and the clamping element by an injection molding technology.

3. The method of manufacturing the electrical connector as claimed in claim 1, wherein the material carrier has a first opening penetrating through one end of the material carrier, and a second opening penetrating through another end of the material carrier in opposite punched downward to form a first extension portion and a second extension portion, a surface of the first extension portion is recessed to form a plurality of first slots arranged transversely, a surface of the second extension portion is recessed to form a plurality of second slots arranged transversely, each of the plurality of the clamping portions is mounted in the plurality of the first slots and the second slots of the material carrier, respectively.

4. The method of manufacturing the electrical connector as claimed in claim 3, wherein a plurality of insertion slots is located between the first extension portion and the second extension portion, and vertically penetrated through the material carrier, a middle of each of the clamping portions protrude upward to form two pillars with opposite each other, the pillars of the plurality of the clamping portions are inserted into the plurality of the insertion slots.

5. The method of manufacturing the electrical connector as claimed in claim 3, wherein the second extension portion is disposed parallel with the first extension portion.

6. The method of manufacturing the electrical connector as claimed in claim 3, wherein the material carrier has a first opening penetrating through one end of the material carrier, and a second opening penetrating through another end of the material carrier in opposite to the first opening, the first extension portion is protruded downward from a side wall of the first opening adjacent to the second opening, the second extension portion is protruded downward from a side wall of the second opening in opposite to the first extension portion.

7. The method of manufacturing the electrical connector as claimed in claim 6, wherein a first pin and a second pin are respectively extending from each of the clamping portions, the plurality of the terminals and the first pin of each of the clamping portions located within the first opening, the second pin of each of the clamping portions located within the second opening.

8. The method of manufacturing the electrical connector as claimed in claim 1, wherein the material carrier and the material belt are made of metal materials.

9. The method of manufacturing the electrical connector as claimed in claim 1, wherein the material carrier and the material belt are automatically provided for manufacturing the electrical connector by way of reels, so the plurality of the terminals and the clamping element are automatically electroplated, the insulating housing is automatically molded to the plurality of the terminals and the clamping element.

10. The method of manufacturing the electrical connector as claimed in claim 1, wherein a terminal base is formed in bottom of the locating groove which has a plurality of terminal slots penetrating through the first surface and the second surface of the insulating housing, the plurality of the terminals are mounted in the plurality of the terminal slots, each of the terminals has a contacting end and an assembling end, the contacting end is assembled beyond the first surface of the insulating housing after assembled.

11. A method of manufacturing an electrical connector, comprising steps of:

stamping a plurality of terminals together with a plurality of clamping portions and a clamping element having a material belt, respectively;

inserting and fixing the plurality of the terminals together with the plurality of the clamping portions to a material carrier, and placing the material belt above the material carrier, the material carrier opening a plurality of limiting slots, the plurality of the clamping portions being limited in the plurality of the limiting slots, wherein the material carrier has a first opening penetrating through one end of the material carrier, and a second opening penetrating through another end of the material carrier in opposite to the first opening;

electroplating the plurality of the terminals and the clamping element;

molding an insulating housing to the plurality of the terminals and the clamping element; and separating the material carrier, the plurality of the clamping portions and the material belt from the plurality of the terminals and the clamping element respectively, thereby completing manufacturing the electrical connector which has the insulating housing, the plurality of the terminals and the clamping element.

12. The method of manufacturing the electrical connector as claimed in claim 11, wherein the first opening and the second opening are respectively punched downward to form a first extension portion and a second extension portion, the first extension portion is protruded downward from a side wall of the first opening adjacent to the second opening, the second extension portion is protruded downward from a side wall of the second opening in opposite to the first extension portion, a surface of the first extension portion is recessed upward to form a plurality of first slots arranged transversely, a surface of the second extension portion is recessed to form a plurality of second slots arranged transversely, each of the plurality of the clamping portions is mounted in the plurality of the first slots and second slots of the material carrier, respectively.

13. The method of manufacturing the electrical connector as claimed in claim 12, wherein a middle of the material carrier opens a plurality of insertion slots vertically penetrating through the material carrier, and located between the first extension portion and the second extension portion, two portions of a middle portion of each clamping portion protrude upward to form two pillars, the pillars of the plurality of the clamping portions are inserted into the plurality of the insertion slots.

14. The method of manufacturing the electrical connector as claimed in claim 12, wherein the second extension portion is disposed parallel with the first extension portion.

15. The method of manufacturing the electrical connector as claimed in claim 11, wherein a first pin and a second pin are respectively extending from each of the clamping portions, the plurality of the terminals and the first pin of each of the clamping portions located within the first opening, the second pin of each of the clamping portions located within the second opening.

16. The method of manufacturing the electrical connector as claimed in claim 11, wherein the material carrier has a first pin and a second pin are respectively extending from each of the clamping portions in which the first pin and the second remain a distance with each other, and the plurality of the terminals and the first pin of each of the clamping portions located within the first opening, the second pin of each of the clamping portions located within the second opening.

* * * * *